US010172505B2

(12) United States Patent
Tai et al.

(10) Patent No.: US 10,172,505 B2
(45) Date of Patent: Jan. 8, 2019

(54) CLEANING PAD FOR A ROBOT CLEANER

(71) Applicant: KANG NA HSIUNG ENTERPRISE CO., LTD., Tainan (TW)

(72) Inventors: Jung-Chi Tai, Tainan (TW); Ho-Hsi Yang, Tainan (TW); Chien-Chung Su, Tainan (TW); Lung-Chieh Lin, Tainan (TW)

(73) Assignee: KANG NA HSIUNG ENTERPRISE CO., LTD., Tainan (TW)

( * ) Notice: Subject to any disclaimer, the term of this patent is extended or adjusted under 35 U.S.C. 154(b) by 28 days.

(21) Appl. No.: 15/435,586

(22) Filed: Feb. 17, 2017

(65) Prior Publication Data

US 2018/0140154 A1 May 24, 2018

(30) Foreign Application Priority Data

Nov. 23, 2016 (TW) ..... 105138331 A
Nov. 23, 2016 (TW) ..... 105217849 U

(51) Int. Cl.

| | |
|---|---|
| ***A47L 13/18*** | (2006.01) |
| ***A47L 13/04*** | (2006.01) |
| ***A47L 11/28*** | (2006.01) |
| ***A47L 11/40*** | (2006.01) |
| ***A47L 13/44*** | (2006.01) |
| *A47L 13/06* | (2006.01) |

(52) U.S. Cl.

CPC ..... *A47L 11/4036* (2013.01); *A47L 11/28* (2013.01); *A47L 13/44* (2013.01); *A47L 13/04* (2013.01); *A47L 13/06* (2013.01); *A47L 2201/00* (2013.01)

(58) Field of Classification Search

CPC ..... A47L 13/18; A47L 13/04; A47L 13/06; A47L 13/12; A47L 11/28
USPC ..... 15/229.11, 229.12, 229.13
See application file for complete search history.

(56) References Cited

U.S. PATENT DOCUMENTS

| | | | | |
|---|---|---|---|---|
| 94,477 A * | 9/1869 | Crowell | ..... | A47L 13/18 15/227 |
| 2,093,268 A * | 9/1937 | Dyer | ..... | A47L 13/04 15/229.12 |
| 2,287,801 A * | 6/1942 | Hepner | ..... | A47L 13/04 15/229.13 |
| 2009/0293216 A1* | 12/2009 | Lee | ..... | A47L 13/29 15/229.11 |

FOREIGN PATENT DOCUMENTS

| | | | | |
|---|---|---|---|---|
| WO | WO 2007044275 A1 * | 4/2007 | ..... | A47L 13/04 |

* cited by examiner

*Primary Examiner* — Michael Jennings
(74) *Attorney, Agent, or Firm* — Foley & Lardner LLP

(57) ABSTRACT

A cleaning pad for a robot cleaner includes a back piece, an absorbent sheet, and a water permeable web. The water permeable web has a web body which is of such a dimension as to form a downward draping unit to shield the absorbent sheet. The downward draping unit is embossed toward the back piece and along at least one line oriented in a lengthwise direction to form successive downward draping members each defining a height between a lowermost area thereof and a lower major surface of the back piece. The heights of the successive downward draping members are incrementally decreased from a rearmost one of the successive downward draping members to a frontmost one of the successive downward draping members.

8 Claims, 4 Drawing Sheets

CLEANING PAD FOR A ROBOT CLEANER

CROSS-REFERENCE TO RELATED APPLICATION

This application claims priority of Taiwanese Patent Application No. 105138331, filed on Nov. 23, 2016 and Taiwanese Patent Application No. 105217849, filed on Nov. 23, 2016.

FIELD

The disclosure relates to a cleaning pad, and more particularly to a cleaning pad for a robot cleaner.

BACKGROUND

A robot cleaner is a home electrical appliance which is capable of collecting dirt particles such as dust, hair, and the like from a floor surface by means of vacuum suction or by a cleaning pad detachably connected to a bottom surface thereof while autonomously moving in a predetermined region.

Generally, the robot cleaner travels in a forward direction when in operation. A conventional cleaning pad detachably connected to a bottom surface of the robot cleaner is configured with a substantially flat bottom surface which is in substantially full contact with the floor surface to be cleaned while the robot cleaner is in operation. As a result, dirt particles such as dust, hair, and the like usually accumulate at a front portion of the cleaning pad, so that the cleaning effect is unsatisfactory.

SUMMARY

An object of the disclosure is to provide a cleaning pad for a robot cleaner such that a satisfactory cleaning effect may be achieved.

According to the disclosure, there is provided a cleaning pad for a robot cleaner having a bottom surface. The cleaning pad comprises a pad body which includes a back piece, an absorbent sheet, and a water permeable web. The back piece extends in a lengthwise direction, and has an upper major surface for being attached to the bottom surface of the robot cleaner, a lower major surface opposite to the upper major surface in an upward direction, and a front edge and rear edge opposite to each other in a forward-and-rearward direction. The absorbent sheet is disposed to underlie the lower major surface of the back piece. The water permeable web has a front marginal end and a rear marginal end configured to be connected to the front edge and the rear edge of the back piece, respectively, and a web body disposed between the front marginal end and the rear marginal end. The web body is of such a dimension as to form a downward draping unit to shield the absorbent sheet. The downward draping unit is embossed toward the back piece and along at least one line oriented in the lengthwise direction so as to form a plurality of successive downward draping members each defining a height between a lowermost area thereof and the lower major surface of the back piece. The heights of the successive downward draping members are incrementally decreased from a rearmost one of the successive downward draping members to a frontmost one of the successive downward draping members.

BRIEF DESCRIPTION OF THE DRAWINGS

Other features and advantages of the disclosure will become apparent in the following detailed description of the embodiment (s) with reference to the accompanying drawings, of which.

DETAILED DESCRIPTION

Figure 1:
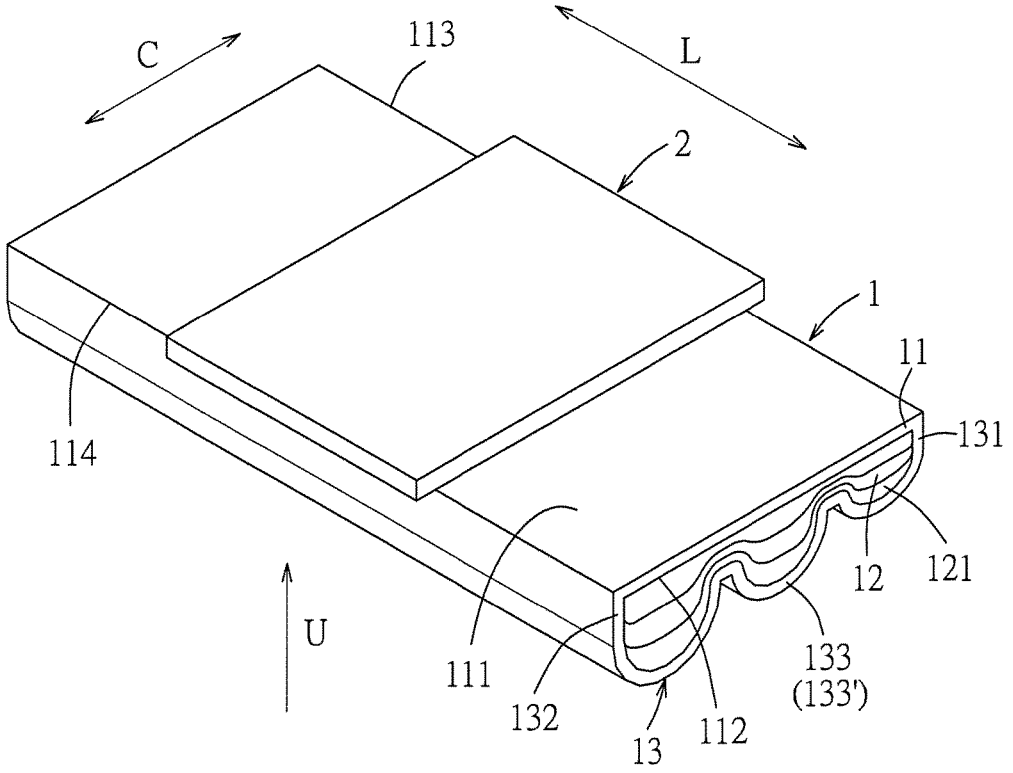
FIG. 1 is a schematic perspective view of a first embodiment of a cleaning pad according to the disclosure.

Before the disclosure is described in greater detail, it should be noted that where considered appropriate, reference numerals or terminal portions of reference numerals have been repeated among the figures to indicate corresponding or analogous elements, which may optionally have similar characteristics.

Figure 2:
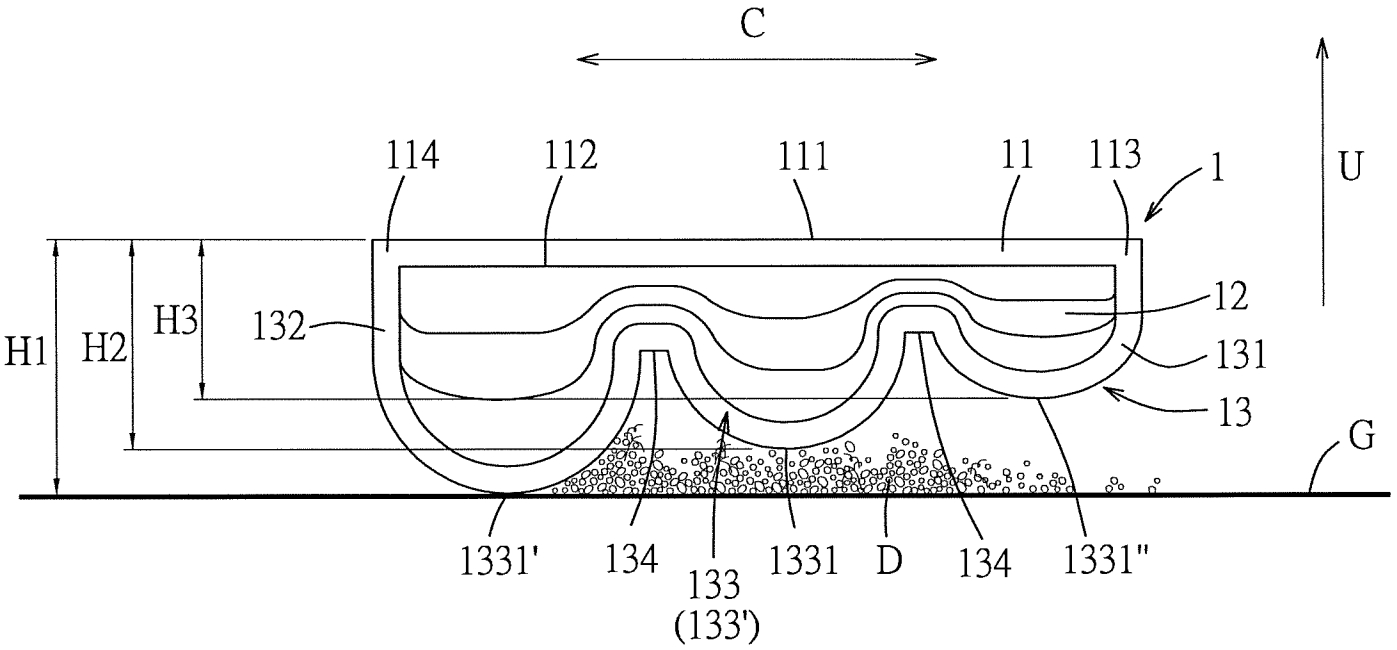
FIG. 2 is a schematic side view of the first embodiment.
Figure 3:
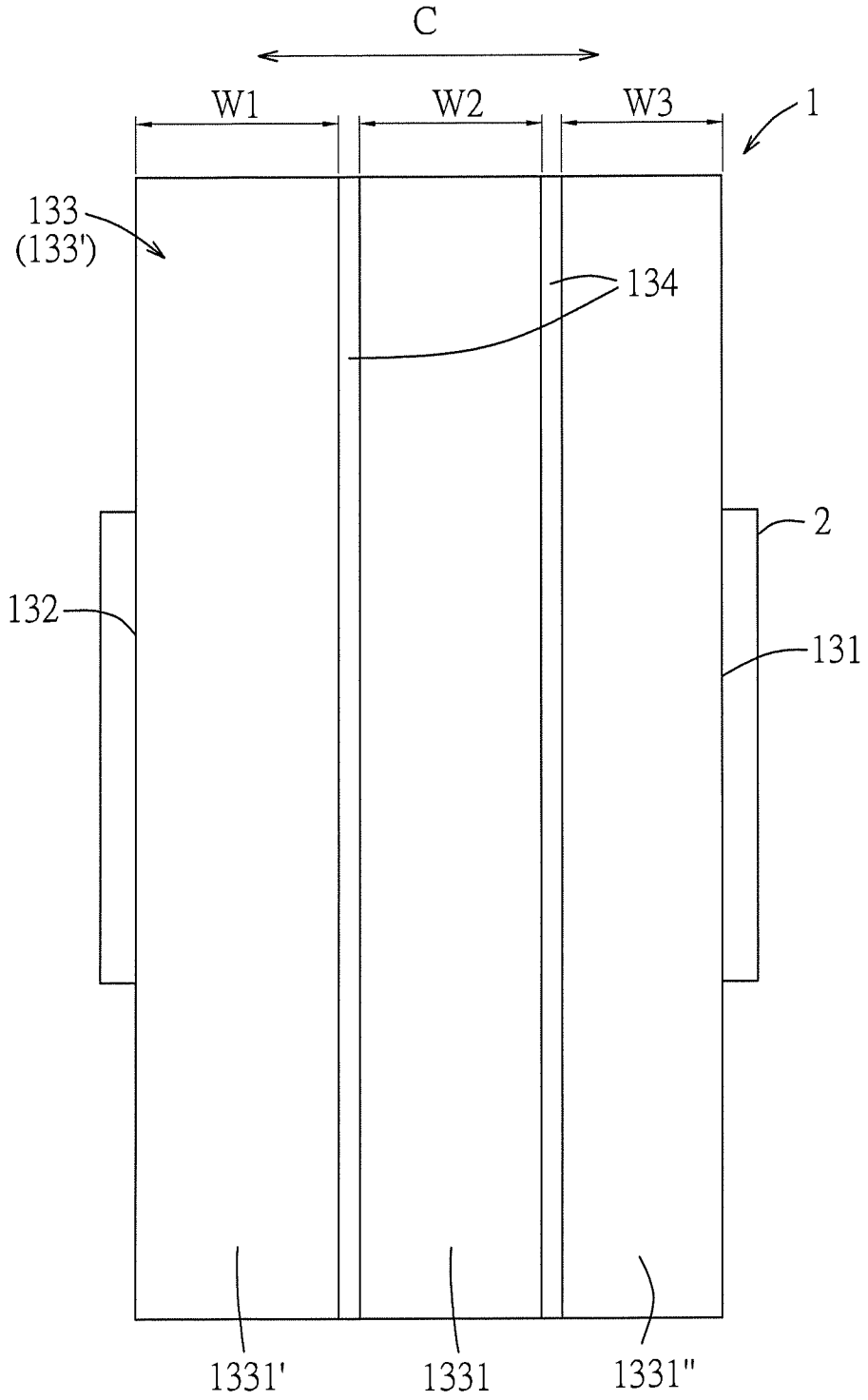
FIG. 3 is a schematic bottom view of the first embodiment.

Referring to FIGS. 1, 2, and 3, a first embodiment of a cleaning pad according to the disclosure is shown to include a pad body 1 and an abutment piece 2, and is to be attached to a bottom surface of a robot cleaner (not shown).

The pad body 1 includes a back piece 11, an absorbent sheet 12, and a water permeable web 13.

The back piece 11 extends in a lengthwise direction (L), and has an upper major surface 111 for being attached to the bottom surface of the robot cleaner, a lower major surface 112 opposite to the upper major surface 111 in an upward direction (U), and a front edge 113 and a rear edge 114 opposite to each other in a forward-and-rearward direction (C).

The absorbent sheet 12 is disposed to underlie the lower major surface 112 of the back piece 11, and includes a plurality of nonwoven layers 121 bonded together, for example, using an adhesive. In the embodiment, the absorbent sheet 12 includes two airlaid nonwoven layers and a latex-bonded nonwoven layer sandwiched between the airlaid nonwoven layers.

The water permeable web 13 has a front marginal end 131 and a rear marginal end 132 configured to be connected to the front edge 113 and the rear edge 114 of the back piece 11, respectively, and a web body 133 disposed between the front marginal end 131 and the rear marginal end 132. The web body 133 is of such a dimension as to forma downward draping unit 133' to shield the absorbent sheet 12. The downward draping unit 133' is embossed toward the back piece 11 and along a plurality of lines 134 oriented in the lengthwise direction (L) via a hot-pressing treatment or a supersonic treatment so as to form a plurality of successive downward draping members, each of which defines a height between a lowermost area thereof and the lower major surface 112 of the back piece 11. The heights of the successive downward draping members are incrementally decreased from a rearmost one of the successive downward draping members to a frontmost one of the successive downward draping members. Specifically, in the embodiment, three successive downward draping members 1331', 1331, 1331" are formed, each of which defines a height (H1, H2, H3) between a lowermost area thereof and the lower major surface 112 of the back piece 11, and the heights (H1, H2, H3) of the three successive downward draping members 1331', 1331, 1331" are incrementally decreased from the downward draping member 1331' (the rearmost one) to the downward draping member 1331" (the frontmost one) (i.e., H1>H2>H3).

In addition, each of the successive downward draping members has two opposite edges extending in the lengthwise direction (L) and defines a width between the opposite edges thereof. The widths of the successive downward draping members are incrementally decreased from the rearmost one of the successive downward draping members to the frontmost one of the successive downward draping members. Specifically, in the embodiment, each of the three successive downward draping members (1331', 1331, 1331") defines a width (W1, W2, W3) between the opposite edges thereof, and the widths (W1, W2, W3) of the three successive downward draping members 1331', 1331, 1331" are incrementally decreased from the downward draping member 1331' (the rearmost one) to the downward draping member 1331" (the frontmost one) (i.e., W1>W2>W3).

The back piece 11 and the water permeable web 13 may be made from a material independently selected from the group consisting of a woven fabric, a nonwoven fabric, and a porous plastic film. In the embodiment, the back piece 11 is formed integrally with the water permeable web 13 from the same material.

The abutment piece 2 is configured to detachably connect the upper major surface 111 of the back sheet 11 of the pad body 1 to the bottom surface of the robot cleaner. The configuration of the abutment piece 2 may be adjusted according to the specific connecting mechanism for connecting the pad body 1 to the bottom surface of the robot cleaner. For example, the abutment piece 2 may include a hook-and-loop type fastener.

In use, the cleaning pad of the disclosure is detachably connected to the bottom surface of the robot cleaner such that the downward draping unit 133' thereof faces toward a floor surface (G) to be cleaned and that the front marginal end 131 and the rear marginal end 132 of the water permeable web 13 are opposite to each other in the forward-and-rearward direction (C). When the robot cleaner is operated to remove dirt particles such as dust, hair and the like, from the floor surface (G), the cleaning pad of the disclosure moves forwardly such that the front marginal end 131 of the water permeable web 13 reaches the dirt particles on the floor surface (G) sooner than the rear marginal end 132 of the water permeable web 13. Since the heights of the successive downward draping members of the water permeable web 13 are incrementally decreased from the rearmost one of the successive downward draping members to the frontmost one of the successive downward draping members, a relatively large amount of the dirt particles may be collected in a space below the downward draping unit 133' for adhesion by the cleaning pad. Therefore, a satisfactory cleaning effect may be effectively achieved by the cleaning pad of the disclosure.

It should be noted that in practice, since the pad body 1 is soft and compressible, the successive downward draping members of the water permeable web 13 may come into contact with the floor surface (G) to be cleaned. However, the frictions between the successive downward draping members and the floor surface (G) are incrementally decreased from the rearmost one of the successive downward draping members to the frontmost one of the successive downward draping members due to the specific configuration of the downward draping unit 133', i.e., the friction between the rearmost one of the successive downward draping members and the floor surface (G) is largest among the successive downward draping members of the downward draping unit 133'. Therefore, dirt particles can be effectively collected in the space below the downward draping unit 133' and be stopped by the rearmost one of the successive downward draping members.

Figure 4:
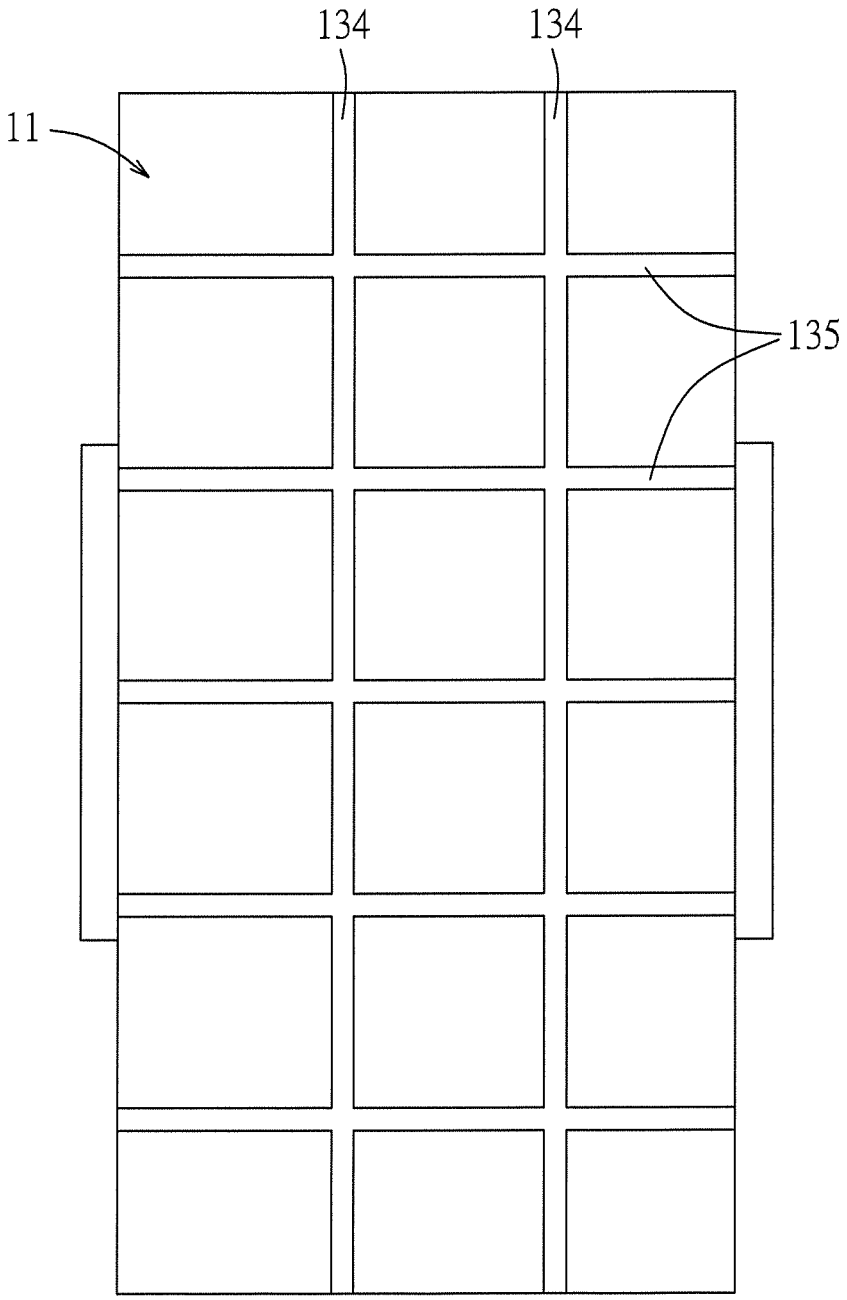
FIG. 4 is a schematic bottom view of a second embodiment of a cleaning pad according to the disclosure.

Referring to FIG. 4, a second embodiment of a cleaning pad according to the disclosure is shown to be similar to the first embodiment except that the downward draping unit 133' is further embossed toward the back piece 11 and along a plurality of lines 135 transverse to the lengthwise direction (L) via a hot-pressing treatment or a supersonic treatment to thereby provide more space below the downward draping unit 133' for collecting dirt particles. Thus, the cleaning effect may be further enhanced.

In the description above, for the purposes of explanation, numerous specific details have been set forth in order to provide a thorough understanding of the embodiment(s). It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects.

While the disclosure has been described in connection with what is (are) considered the exemplary embodiment(s), it is understood that this disclosure is not limited to the disclosed embodiment(s) but is intended to cover various arrangements included within the spirit and scope of the broadest interpretation so as to encompass all such modifications and equivalent arrangements.

What is claimed is:

1. A cleaning pad for a robot cleaner having a bottom surface, comprising:

a pad body including a back piece extending in a lengthwise direction and having an upper major surface for being attached to the bottom surface of the robot cleaner and a lower major surface opposite to said upper major surface in an upward direction, and a front edge and a rear edge opposite to each other in a forward-and-rearward direction;

an absorbent sheet disposed to underlie said lower major surface of said back piece; and a water permeable web having a front marginal end and a rear marginal end configured to be connected to said front edge and said rear edge of said back piece, respectively, and a web body which is disposed between said front marginal end and said rear marginal end, and which is of such a dimension as to form a downward draping unit to shield said absorbent sheet, said downward draping unit being embossed toward said back piece and along at least one line oriented in the lengthwise direction so as to form a plurality of successive downward draping members each defining a height between a lowermost area thereof and said lower major surface of said back piece, wherein the heights of said successive downward draping members are incrementally decreased from a rearmost one of said successive downward draping members to a frontmost one of said successive downward draping members.

2. The cleaning pad according to claim 1, wherein each of said successive downward draping members has two opposite edges extending in the lengthwise direction and defines a width between said opposite edges thereof, wherein the widths of said successive downward draping members are incrementally decreased from the rearmost one of said successive downward draping members to the frontmost one of said successive downward draping members.

3. The cleaning pad according to claim 1, wherein said downward draping unit is further embossed toward said back piece and along a plurality of lines transverse to the lengthwise direction.

4. The cleaning pad according to claim 1, wherein said absorbent sheet includes a plurality of nonwoven layers.

5. The cleaning pad according to claim 1, wherein said back piece and said water permeable web are made from a material independently selected from the group consisting of a woven fabric, a nonwoven fabric, and a porous plastic film.

6. The cleaning pad according to claim 5, wherein said back piece is formed integrally with said water permeable web.

7. The cleaning pad according to claim 1, further comprising an abutment piece configured to detachably connect said upper major surface of said back piece of said pad body to the bottom surface of the robot cleaner.

8. The cleaning pad according to claim 7, wherein said abutment piece includes a hook-and-loop type fastener.

* * * * *